United States Patent [19]

Liberg

[11] 3,989,070

[45] Nov. 2, 1976

[54] SYSTEM FOR AND METHOD OF CARRYING OUT WASH-DRAINING, AFTER-DRAINING AND THE LIKE

[75] Inventor: Lars-Olof Liberg, Gothenburg, Sweden

[73] Assignee: Jonkopings Mekaniska Werkstads AB, Jonkoping, Sweden

[22] Filed: Mar. 27, 1975

[21] Appl. No.: 562,774

[30] Foreign Application Priority Data

Apr. 26, 1974 Sweden ..... 7405616

[52] U.S. Cl. ..... 141/1; 141/91; 137/240

[51] Int. Cl.[2] ..... B65B 3/04

[58] Field of Search ..... 137/237, 238, 240; 141/1, 89–92

[56] References Cited

UNITED STATES PATENTS 3,845,791 11/1974 Friendship ..... 141/91

*Primary Examiner*—Houston S. Bell, Jr.

*Attorney, Agent, or Firm*—Hubbell, Cohen, Stiefel & Gross

[57] ABSTRACT

A system, which is preferably located on board a ship having at least one tank for oil or another liquid cargo and is provided for carrying out operations in connection with the unloading and the draining of cargo and/or wash liquid and the cleaning of the cargo tank as well as the handling and refining of polluted wash liquid, comprises a main pump, which is connected to the cargo tank through one main suction pipe and is adapted to substantially empty the cargo tank, means connecting the inlet of the main pump to a wash liquid source, spray means which is provided in the cargo tank for the cleaning thereof and is connected to a pressure fluid source, an air and gas suction off system, which is preferably connected to the main suction line through a gas separation tank, and a drainage pump. This drainage pump, which is preferably of the centrifugal type, is provided for wash-draining and/or after-draining and is driven by a liquid turbine. The inlet of the drainage pump is connected to themain suction pipe or the gas separation tank and is adapted to have air and gas sucked off from its pump wheel by means of the gas suction off system.

29 Claims, 13 Drawing Figures

SYSTEM FOR AND METHOD OF CARRYING OUT WASH-DRAINING, AFTER-DRAINING AND THE LIKE

BACKGROUND OF THE INVENTION

Field of the Invention

This invention relates to a method of carrying out washdraining, after-draining and the like in a system, preferably on board ship having at least on tank for oil or other liquid cargo, for the unloading and the draining of the oil and/or wash liquid or other liquid and for the cleaning of the tank etc, particularly from oil, sediments and other impurities as well as for the handling and refining of the more or less polluted wash liquid, and to a system for carrying out this method. Said system comprises at least one main pump, which is connected to the cargo tank through one preferably shutable main suction pipe and is adapted to substantially empty the cargo tank through a main pressure pipe, means connecting the inlet of the main pump to a flush liquid source, at least one spray nozzle or the like which is provided in the cargo tank for the cleaning thereof and is connected to the pressure pipe of the main pump or another pressure fluid source, at least one drainage pump which is preferably of the centrifugal type and is provided for wash draining and/or after-draining, and an air and gas suction off system, which is preferably connected to the main suction line trough a possible gas separation tank interconnected in the main suction line, and preferably also at least one oil or cargo liquid separation tank and means for transferring cargo and-/or wash liquid from the cargo tank to the cargo liquid separation tank.

The Prior Art

In ships adapted to carry oil cargo there is a need for repeated cleaning of oil tanks, particularly after that the ship has unloaded its oil cargo. On these occasions the tanks are cleaned of residual oil, rust deposits and sediments which have separated out of the cargo oil.

A common, well-known system for this is shown in FIG. 1 which diagrammatically illustrates part of a pump system for the emptying etc. of tanks on board ships or vessels for oil cargo, and FIG. 2 which in a still more simplified way illustrates two interconnected systems of this kind.

From cargo tanks 1 there extends a main suction pipe 2, which is connected to individual tanks through branch-pipes 3 having inlet funnels 4. The main suction pipe 2 leads to a minor gas separation tank 5 and further through a pipe 10 to a main pump 12 having for its principal purpose to unload and empty the cargo tanks 1 of the ship through said suction pipe system 2, 3, 4, 5, 10, through the pressure pipe 13 of the main pump 12 to a shut off valve 49 and further on through a pipe 15 which is detachably connected to tanks ashore (not shown) to which the cargo oil is pumped. The gas separation tank 5 is adapted to prevent gas from reaching the main pump 12 at the emptying of the last amounts of liquid in the cargo tanks 1. Gas (including air) separated in the gas separating tank 5 is pumped off by a vacuum pump or the like 8 through gas pipes 7 and 9. The gas separation tank 5 is preferably also associated with means (not shown) which in response to the liquid level in said tank or in another way operates a shut off valve 6 and a flow regulation valve 14 in the pressure pipe of the main pump 12.

For the sake of simplicity FIG. 1 shows the piping for just one main pump 12. Generally, there are a plurality of main pumps having identical or substantially like pipings or pipe systems. This is illustrated in FIG. 2, which in a very simplified way illustrates two interconnected systems according to FIG. 1 and in which mutually corresponding elements of the two systems have been given the same reference numerals with or without the suffix "*a*,"respectively.

As is shown in FIG. 2 these "parallel" suction pipes 2 are ordinarily shutably interconnected by a connection pipe 43 and a shut off valve 44.

In a corresponding manner the pressure pipes 13 are interconnected by a pipe 45 and a shut off valve 46.

When cleaning the tanks one (or more) main pump(s) 12 which suck(s) wash or flush liquid in the form of sea water from a sea connection 17 through a valve 18 and a sea suction pipe 16 is/are utilized to force water through the pressure pipe 13 to a tank spray pipe 19 which is provided with a shut off valve 48 (a main shut off valve 26 provided in the main suction pipe 2 between a discharge pipe 22 and the gas separation tank 5 is shut during the cleaning operation). The water may pass through a heating means (not shown) before it is supplied through branch pipes 20, which are each provided with an individual shut off valve 70, to spray or flush apparatus 21 in that or those cargo oil tanks, which are to be cleaned.

To make the bottom of the cargo tank 1 well exposed for cleaning it is necessary to maintain the liquid level as low as possible in the cargo tank 1. Because of this, the main pump 12 also delivers driving or propulsive water through a pipe 25 to one (or more) jet pump(s) 23 which through the outlet pipe 22 and the pipes 2 and 3 suck(s) up flush or wash water consumed by the spray apparatus 21 together with impurities, which follow the water, and pumps it to a separator tank 27. This has the consequence that great quantities of air also follow the liquid sucked up by the jet pump 23 into the tank 27.

In the separator tank 27 oil particles are separated from the water on account of the lower density of oil and merge into an oil layer 31 in the upper part of the tank. Heavier impurities sink to the bottom. The purified water may be fed to one or more further separator tank(s) 28 through free flow of liquid in a connection pipe 29 for further purification and is subsequently fed through a pipe 30 over board (not shown) or in return to operating main pump(s) 12.

To expedite separation in the tanks 27 and 28 and to maintain separated oil pumpable, the tanks 27 and 28 are provided with heating means 32 and 33.

When the cleaning of the tanks is finished and all oil in the separator tanks 27–28 has accumulated in the oil layer 31, the water is pumped over board by pipe means, not shown, The separated oil may subsequently be pumped ashore by the main pump 12 which is also connected to the separation tanks 27–28 by a pipe arrangement (not shown).

The drawbacks of the arrangement just described for the draining of flush or wash water are several:

1. Jet pumps require in their described application a quantity of driving water which is greater than their pump capacity, which means that the amount of liquid, which is conducted to the separator tanks, is considerably greater than the quantity of wash water proper.

The consequences hereof are:

1*a*. The separator tanks 27 and 28 must be made large at great expense;

1*b*. due to the large size of the separator tanks, the heating means 32 and 33 are extensive;

1*c*. the separation is not as effective as desired.

2. The jet pump has a low efficiency, which entails a high energy consumption.

3. Since the jet pumps require a great quantity of propulsive or driving water, it may in some cases be necessary to utilize more than one main pump for the cleaning of the tanks (which is made possible by connecting two or more main pumps according to FIG. 2 to the propulsive water pipe 25).

4. On account of the points 1*b*, 2 and 3 above it is often necessary for ships propelled by steam turbines to reduce their speed during the tank cleaning operation due to the fact that the heating means 32 and 33 and the main pump(s) 12 which is/are usually driven by the steam turbine, consume so great a quantity of steam in operation, that the steam generators of the ship can not simultaneously provide the propelling machinery with a sufficient quantity of steam.

5. The mode of operation of the jet pump has as a consequence that oil and oil particles are further mixed with and distributed into the water and that oil is partly emulsified which reduces the separation efficiency in the separator tanks 27 and 28 and/or requires making them large.

6. Jet pumps constitute a source of risk for explosions as a consequence of spark generation caused by static electricity generated by the jet pump.

7. Air and gas pumped by the jet pump are fed together with liquid into the separator tank 27, where air and gas bubble up through the liquid in the tank and bring about a stirring which reduces the oil separation efficiency.

Summary of the Invention

The principal object of the invention is to eliminate the above drawbacks and to improve the cleaning of oil containing water and thereby to reduce the risks of polluting the seas.

Another object of the invention is to improve the after-draining (striking pumping) and to reduce the necessary time therefore when unloading oil, and to obviate such pumping by the main pump as would act abrasively thereupon.

These and other objects are attained by the method and the system according to the invention. Said method is primarily characterized in that gas and air is continuously or intermittently sucked off by the gas suction off system from the pump wheel in the drainage pump, which is preferably driven by a liquid turbine and the inlet of which is normally maintained in open connection with the main suction line or the gas separation tank.

The system according to the invention is primarily characterized in that a drainage pump, which is preferably of the centrifugal type and is provided for wash draining and/or after-draining and is driven by a liquid turbine, has its inlet connected to the main suction pipe or the gas separation tank and is adapted to have air and gas sucked off from its pump wheel by means of the gas suction off system.

Further features and advantages of the invention will become apparent from the following detailed description and the annexed drawings, in which FIGS. 3 – 13 digramatically and as non-limiting examples illustrate some at present preferred embodiments of the invention.

DETAILED DESCRIPTION OF PREFERRED EMBODIMENTS

As used herein, the following terms are intended to have the following meanings:

Flush- or Wash-draining:

The pumping away of flush or wash liquid and impurities which accumulate on the bottom of the tank when cleaning the tanks. (In this case the wash liquid may be constituted of water or, in special cases, of oil).

After-draining:

The pumping away of oil (or water) which can not, or only with difficulty, be unloaded by the main pump when pumping ashore oil cargo (or pumping water ballast over board) on account of the fact that great quantities of air follow the oil (water) into the suction funnels 4 which in its turn depends upon too low an oil (water) level in the cargo tanks 1.

Figure 2:
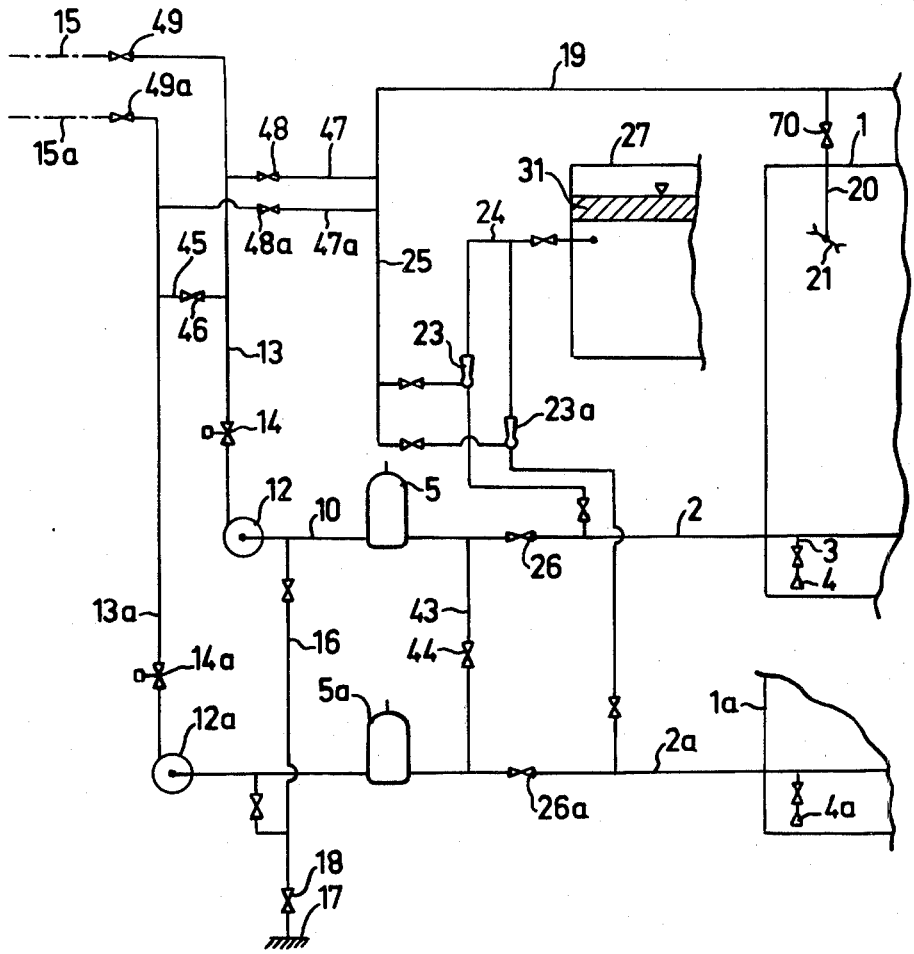
FIG. 2 PRIOR ART
Figure 3:
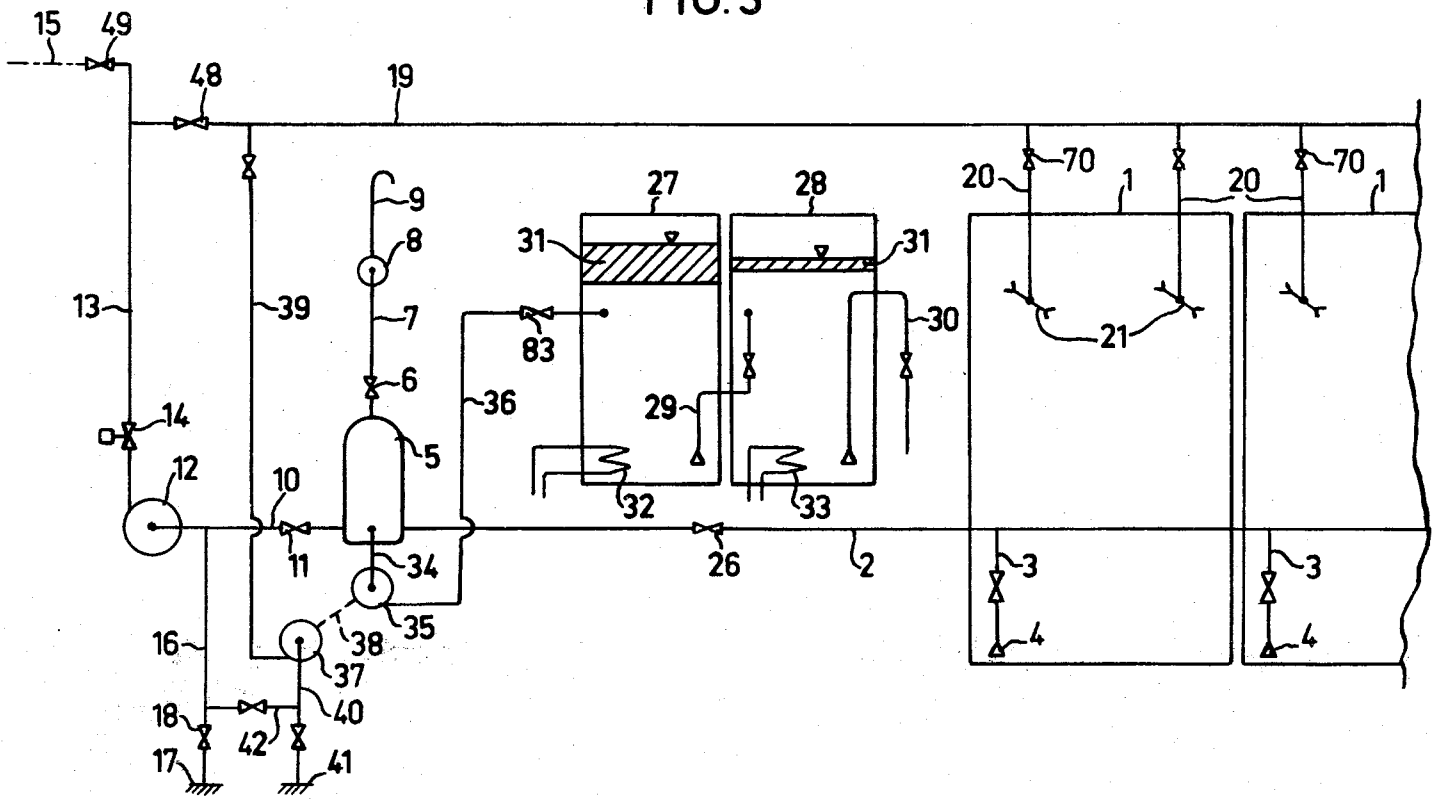
FIG. 3 is a basic diagram of a system devised according to the invention.

In FIG. 3 there is diagramatically illustrated an arrangement according to the invention. The reference numerals 1 – 10, 12 – 21 and 26 – 33 designate the same or corresponding details as in FIGS. 1 – 2.

Figure 4:
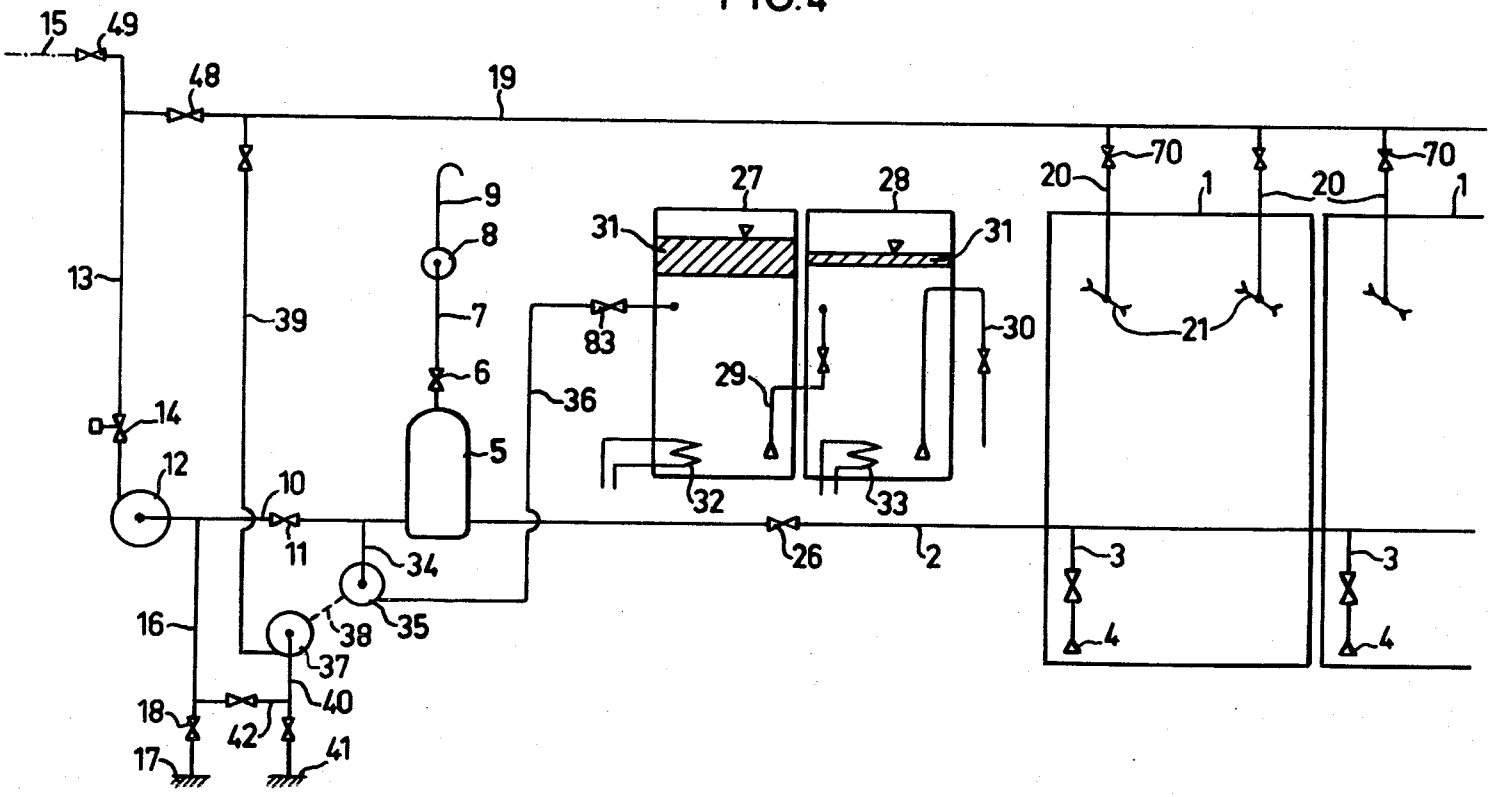
FIG. 4 illustrates a first modification of part of the system according to FIG. 3.

When cleaning the tanks 1 according to the embodiments of the invention illustrated in FIGS. 3 – 4 flushor wash-draining is carried out by means of a centrifugal pump which is generally designated by the reference numeral 35 and is connected to the main suction pipe 2, either directly, as shown in FIG. 4, or through the gas separation tank 5, as is illustrated in FIG. 3, or in another manner which permits utilization of the gas evacuation system (i.e. the gas separation tank 5, the vacuum pump or the like 8 with pipes 7 and 9 and associated means, not shown).

The main pump 12 pumps flush or wash water in the manner described in connection with FIG. 1 from the sea intake 17 to the spray apparatus 21. Flush-draining may be carried out simultaneously by the drainage pump 35 and by means of the gas evacuation system. The main suction pipe 2 and the gas separation tank 5 are on such occasions not in connection with the main pump 12 due to the fact that a closed off valve 11 in the pipe 10 is shut.

During the pumping the gas evacuation system of the main pump is not needed for the main pump but may then serve the drainage pump 35.

At wash-draining and after-draining of such liquid and possible impurities as may be present on the bottom of the tanks 1, air and gas are thus separated, which continously or intermittently follows the liquid into the funnel 4 and through the pipes 3 and 2 and the open main shut off valve 26, in the gas separation tank 5. Air and gas are evacuated by the vacuum pump or the like 8 through the pipes 7 and 9. The gas-free liquid is fed through the suction pipe 34 to the drainage pump 35 which pumps liquid through pipe 36, including its a shut off valve 83, to the separator tank 27. Further purification of the liquid and its flow may take place in the same way as described in connection with FIG. 1.

Since centrifugal pumps generally cease pumping liquid when air enters the pump wheel, the drainage pump 35 is preferably arranged with its pump axis vertical and its pump wheel inlet facing upwards. In this manner air or gas which on account of temporary lowerings of the level in the gas separation tank 5 and/or the main suction duct has filled the pump wheel, may freely flow back through the wheel inlet, as soon as the liquid level in the gas separation tank 5 and the pipe 2 rises above the inlet of the drainage pump 35. On account hereof the drainage pump 35 will pump liquid as soon as such is present up to a certain level in the main suction pipe 2 and the gas separation tank 5.

The drainage pump 35 should preferably be dimenisoned in such a way that it has a capacity which somewhat exceeds the total amount of liquid which is supplied by the spray apparatus 21 to that cargo tank from which flush-draining is desired.

Due to the relative over-capacity of the drainage pump 35 so low a liquid level in the cargo tank(s) 1 will be attained and continously maintained, that air (and gas) follows the liquid which is sucked into the suction funnel 4. At a higher liquid level air is prevented from following the liquid into the suction funnel, due to its low location.

When the drainage pump 35 pumps away more liquid than that supplied through the main suction pipe 2, the liquid level in the gas separation tank 5 will sink, so that the drainage pump temporarily ceases pumping, wholly or in part, since the pump wheel becomes filled with air.

When the liquid level in the gas separation tank 5 rises again, the drainage pump 35 resumes pumping. This occurs alternately at the pace at which liquid is sucked into the main suction pipe 2 through the vacuum which is continously maintained by the vacuum pump 8 or the like.

In a preferred embodiment of the invention the drainage pump 35 is adapted to be driven hydraulically, preferably by a liquid turbine 37 (FIGS. 3 – 4) which by means of a transmission or a shaft propels the drainage pump 35.

The turbine 37 is provided with propulsive liquid through a pipe 39, suitably from main pump 12 which supplies liquid to the spray apparatus 21. The outlet liquid from the turbine 37 may be conducted over board by an outlet pipe, 40 and a sea connection 41 or may be recirculated thru pipe 42 to the sea suction pipe 16 of the main pump.

Figure 1:
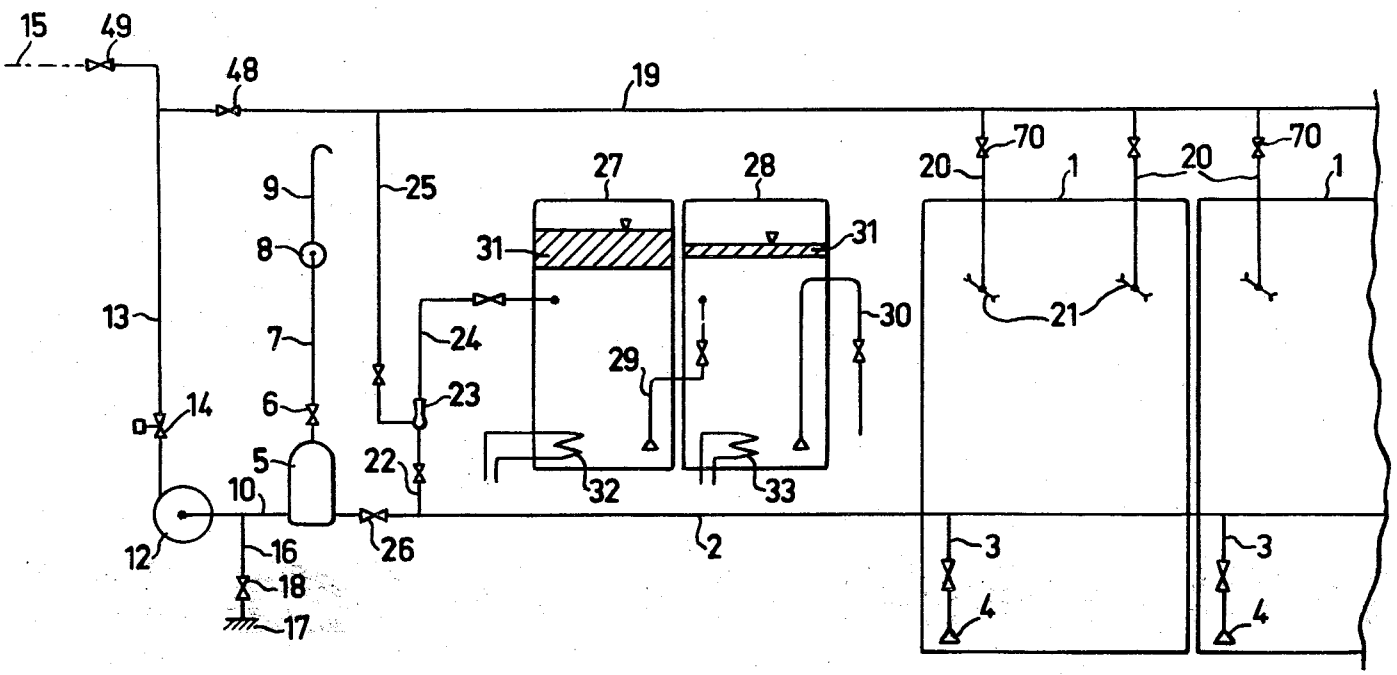
FIG. 1 PRIOR ART
FIGS. 1 – 2 illustrate, as is apparent from the above, two known systems, to which this invention may be applied.

The arrangement according to FIG. 3 is, in the same manner as stated in respect of FIG. 1, illustrated adapted for only one main pump 12 with appurtenant pipe system for the sake of simplicity. Ordinarily, there are two or more main pumps 12 with similar or like arrangements with shut-table connections between the indivicual main suction pipes 2.

FIG. 4 illustrates a piping system or coupling arrangement which differs from that shown in FIG. 3 in that the suction pipe 34 of the drainage pump 35 is connected to the main suction pipe 2 between the gas separation tank 5 and the shut off valve 11. Alternatively (not shown) the suction pipe 34 may be connected to the main suction pipe 2 on another location, where gas may be drawn off by the vacuum pump 8 or the like.

Figure 5:
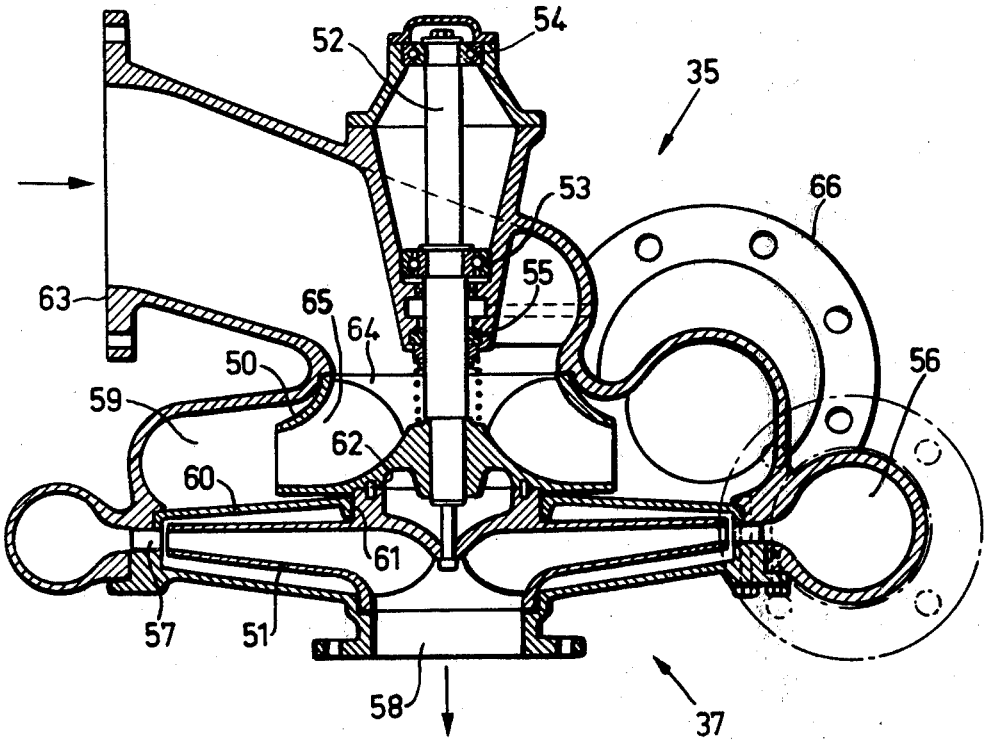
FIG. 5 shows a drainage pump which is built together with a liquid turbine into one unit.

FIG. 5 illustrates the drainage pump 35 in a form in which it has been built together with the liquid turbine 37 into one unit. The pump wheel 50 of the drainage pump and the impeller 51 of the turbine are carried by a common shaft 52, which is journalled in bearings 53 and 54 which are sealed off from liquid by a shaft seal 55. When driving water under pressure is supplied to the inlet 56 of the turbine housing, the impeller is made to rotate in a known way after that said water has passed through the vanes 57. The driving water leaves the turbine through the outlet 48. Liquid in the turbine is prevented from entering the pump chamber 59 by a partition wall 60 and a slot packing 61.

The pump wheel 50 which is mounted together with the impeller 51 is carried along by entraining pieces or connector elements 62 62. If liquid is present above the inlet flange 63 of the pump, such liquid will flow down into the inlet 64 of the pump wheel 50 which faces upwards, and is urged outwards by the vanes 65 of the pump wheel 50 into the pump chamber 59 and therefrom with increased pressure out through the outlet 66 of the pump.

Figure 6:
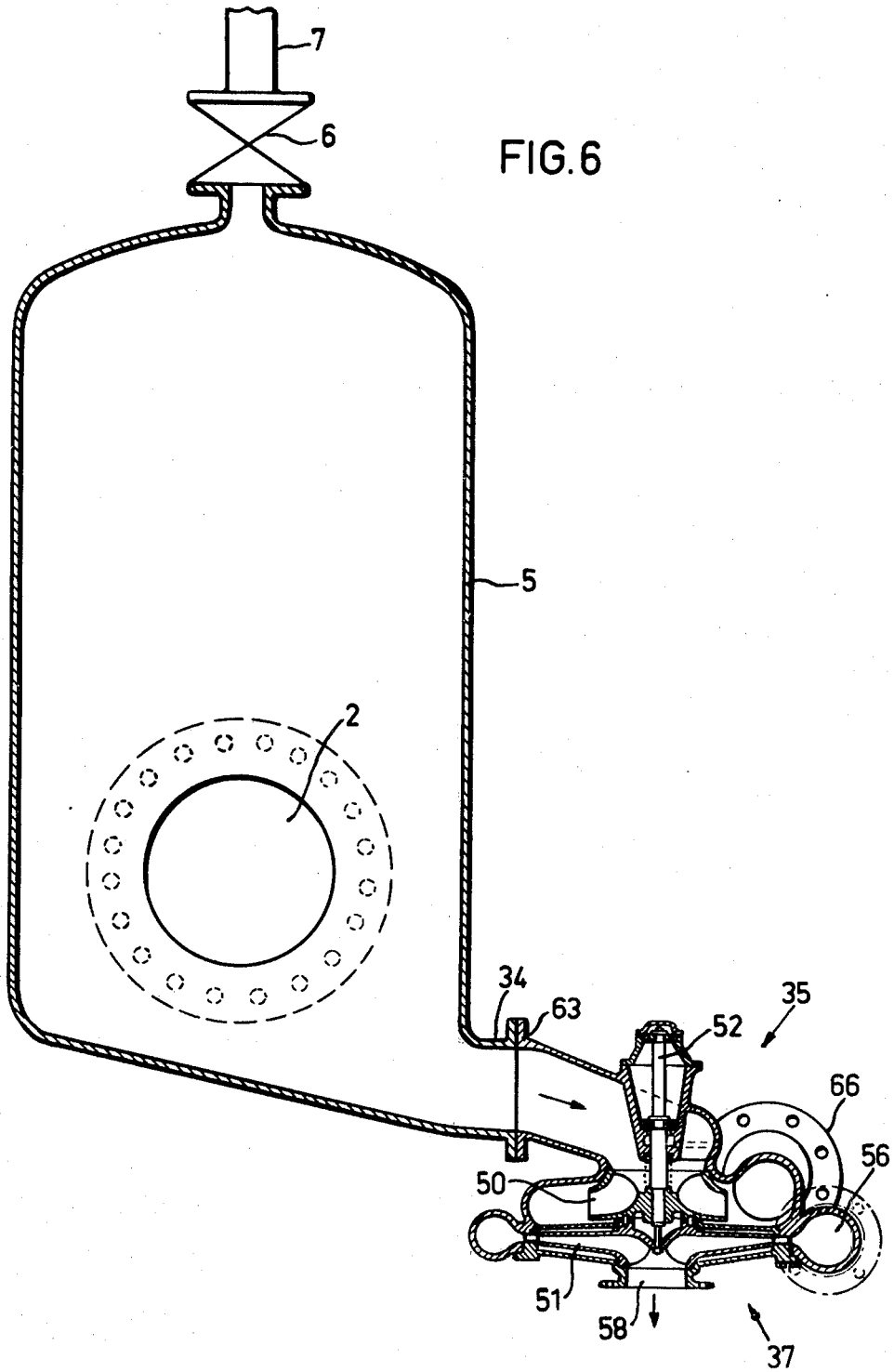
FIG. 6 illustrates more in detail how the drainage pump is connected to the gas separation tank according to FIG. 3.

FIG. 6 illustrates the drainage pump and the turbine 37 built together according to FIG. 5 and connected to the gas separation tank 5, which corresponds to the coupling arrangement according to FIG. 3. Thanks to the connection of the inlet flange of the pump 35 to the gas separation tank 5 on a lower level than the connection of the main suction pipe 2 to the same tank, and to the favourable design of the drainage pump 35, there is made possible firstly a good removal of air from liquid which is supplied to the drainage pump, whereby a favourable operation is obtained, and secondly a complete drainage of the main suction duct 2 and the gas separation tank 5 is respect of liquid, by the drainage pump 35. Complete emptying of the main suction duct 2 is advantageous when the main suction duct subsequently is to be utilized when pumping clean ballast water over board from clean cargo tanks. Hereby, the pumping over board of possible remainders of oil, which may be present in the main suction duct 3, is avoided.

It is advantageous to empty the main suction duct 2 completely also since corrosion therein is reduced in comparison e.g. to a main suction duct 2 which is half filled with sea water.

Gas and air which possibly may follow the liquid into the main suction duct 2 is separated in the gas separation tank 5 and is collected in the upper portion thereof. From here air and gas is evacuated by means of the vacuum pump 8 or the like.

Figure 7:
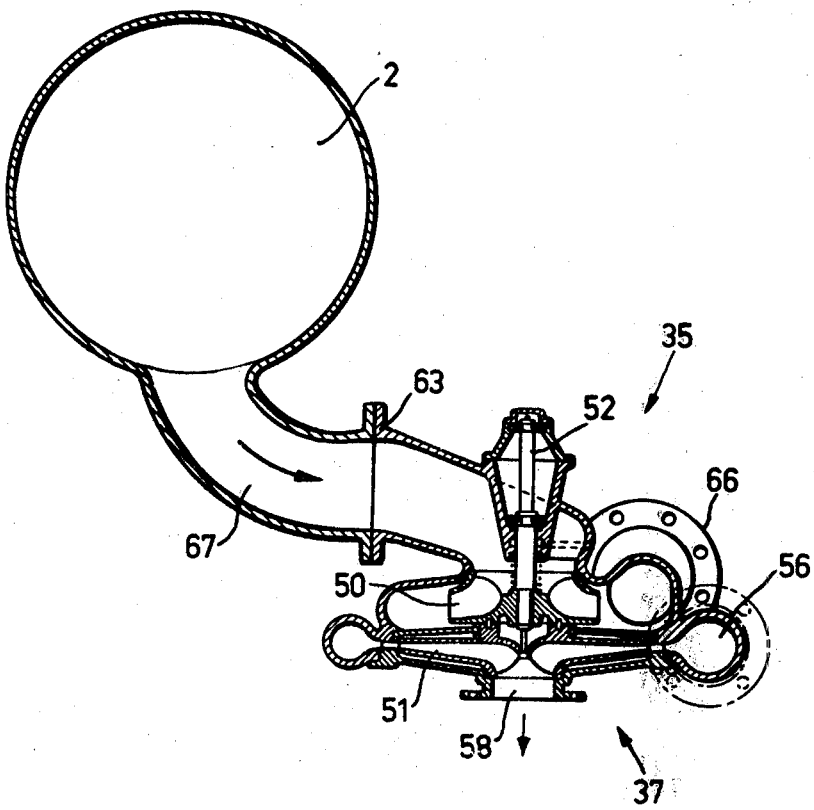
FIG. 7 illustrates in the same way how the drainage pump is connected to the main suction pipe of the main pump according to FIG. 4.

FIG. 7 illustrates in cross section how the drainage pump 35 is connected to the main suction duct 2, which corresponds to the piping arrangement according to FIG. 4. Thanks to the fact that the pump 35 is connected to the downward suction duct 67, which is branched off from the lower portion of the main suction duct 2 (and corresponds to suction pipe 34 in FIG. 4), a favourable removal of air from the liquid is attained.

Gas and air which follows the liquid in the main suction duct 2 is accumulated in the upper portion thereof, from which it flows over to the gas separation tank 5.

Figure 8:
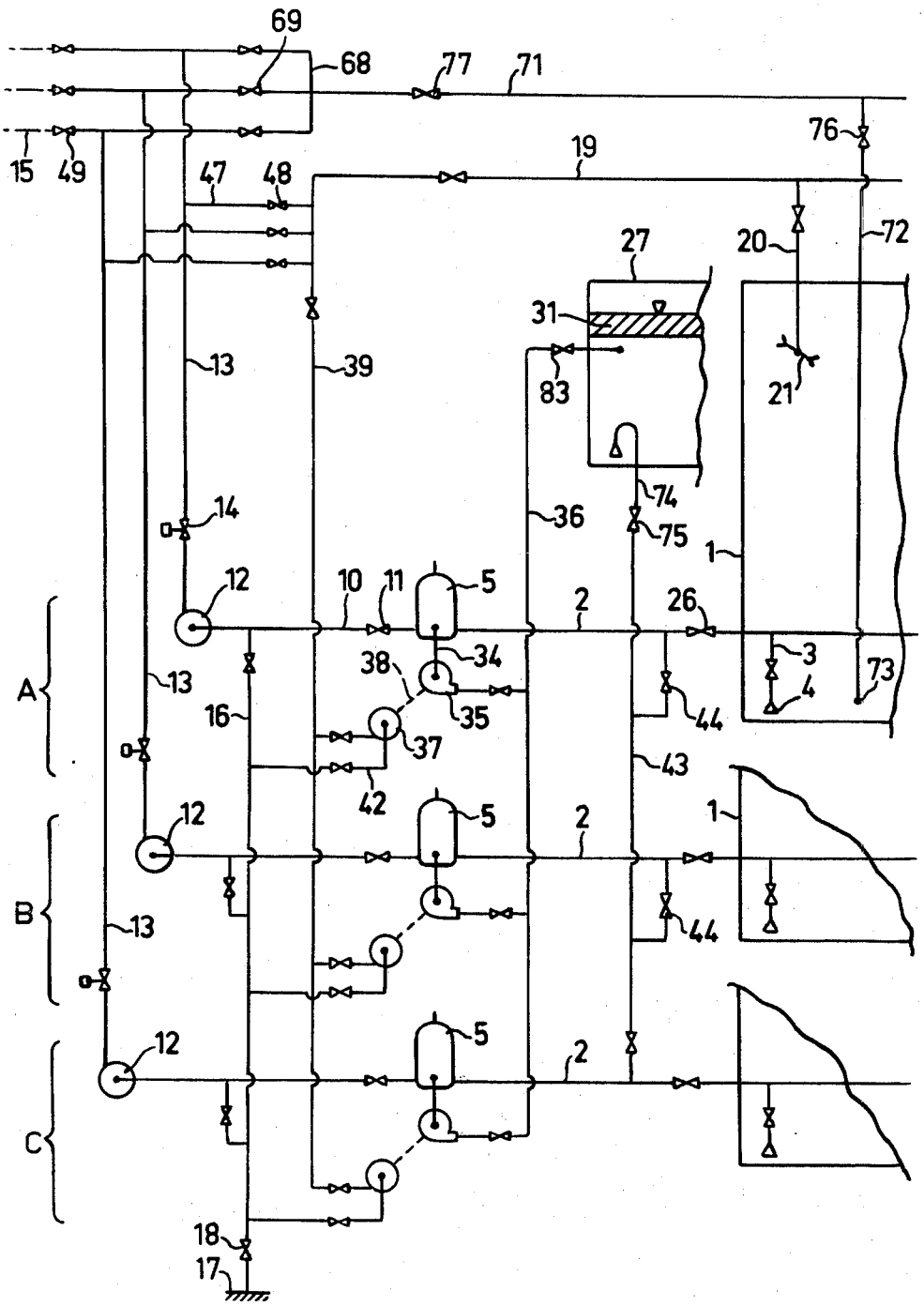
FIG. 8 illustrates the basic diagram according to FIG. 3 adapted to an arrangement including three main pumps.

FIG. 8 shows three main pumps 12 having pipe systems according to FIG. 3 which are interconnected. The tank spray or wash pipe 19 and the propulsive liquid pipe 39 may have liquid supplied to them by any main pump 12 through connection pipes 47 with shut off valves 48. The three main suction pipes 2 are selectively interconnectable by a connection pipe 43 having shug off valves 44.

The oil separation tank 27 is provided with an evacuation pipe 74 having a shut off valve 75. Thanks to the connection of the evacuation pipe 74 to the connection pipe 43 the oil separation tank 27 may be emptied by anyone of the three main pumps 12.

The pressure pipes 13 of the main pumps 12 are selectively interconnectable by a connection pipe 68 and shut off valves 69. A ballast filling pipe 71 which is shown only in part is connected to certain cargo tanks 1 by branch pipes 72 (only one pipe is shown) having a mouth 73 and a shut off valve 76. The ballast filling pipe may have water supplied to it from the sea intake by either main pump 12 which pumps water through its pressure pipe 13, connection pipe 68 and shut off valve 76 for further distribution to the desired or selected cargo tanks 1.

Pipe system A is that pipe system which is principally associated with the upper main pump 12 in FIG. 8. The pipe systems B and C are associated with the central main pump and the lower main pump, respectively, in the Figure in a corresponding way.

The invention brings about a series of advantages, principally due to the fact that any liquid which is fed to the separation tanks for separation purposes is constituted solely of that quantity of liquid which is sucked up from the bottom of the cargo tanks 1 during the tank cleaning operation.

In prior arrangements comprising ejectors the propulsive water of the ejectors was, in contradistinction to the above, also supplied to the separation tanks.

On account of the reduced quantity of water which according to the invention is supplied to the cleaning or washing system (here described as separation tanks) the following advantages are attained:

A. polluted water is cleaned better;

B. the size of the cleaning system may be reduced considerably (important economic gain);

C. the heating means in the cleaning system may be substantially reduced in size which also reduces the energy consumption;

D. alternative, cheaper structural arrangements, such as smaller, prefabricated separation tanks, instead of conventional tanks built into the hull, can be utilized in the cleaning system;

E. the ship will in many instances get a greater cargo-carrying capacity (in particular ships intended for refined products of combined vessels, such as OBO (oil-bulk-ore) ships and ore-carrying tankers), since it is possible to use smaller separation tanks.

Further advantages which are attained by the invention may be summarized as follows:

F. the separation of oil from water is not disturbed by any accompanying air;

G. the consumption of liquid (pressure water) is reduced, which means that the number of pumps in operation for the pumping of wash water possibly may be reduced, whereby also the energy consumption is reduced (in certain instances the cruising speed during tank cleaning may be maintained higher);

H. possibilities of simultaneous cleaning of an increased number of cargo tanks are created thanks to the relative reduction of the quantity of liquid which has to be cleaned (in this way the total tank cleaning time is reduced, which is essential, particularly in ships which are to carry another cargo, e.g. ore, after having carried oil);

I. the drainage pump 35 (a centrifugal pump) does not entail any risk of explosions as a consequence of electrostatic spark generation;

J. the drainage pump 35 may be dimensioned and designed for that quantity of liquid and those pollutants (sand and other) which follow the liquid at wash-draining and after-draining and will hereby as well as on account of its upward inlet be more suited for wash-draining and after-draining than the main pump 12 (which is generally too big and too sensitive for impurities and is thus not suitable for wash-draining;

K. the drainage pump 35 may be conveniently located due to the fact that it is preferably driven hydraulically (in the locations in question on board tankers it is not appropriate to use an electric driving motor on account of the danger of explosion).

Another very important advantage when unloading oil cargo resides therein, that the emptying of the very last residue of oil, the so called after-draining or stripping pumping may to advantage be carried out by the drainage pump from those cargo tanks which have been almost drained by the main pump, over to another cargo tank or possibly to a tank which is otherwise used for the cleaning of wash water.

This means that the last residues of cargo oil from the individual cargo tanks 1 may be pumped over by the drainage pump to a single tank or to a limited number of tanks, from where the collected oil from the after-draining easily may be unloaded by a main pump 12.

Figure 9:
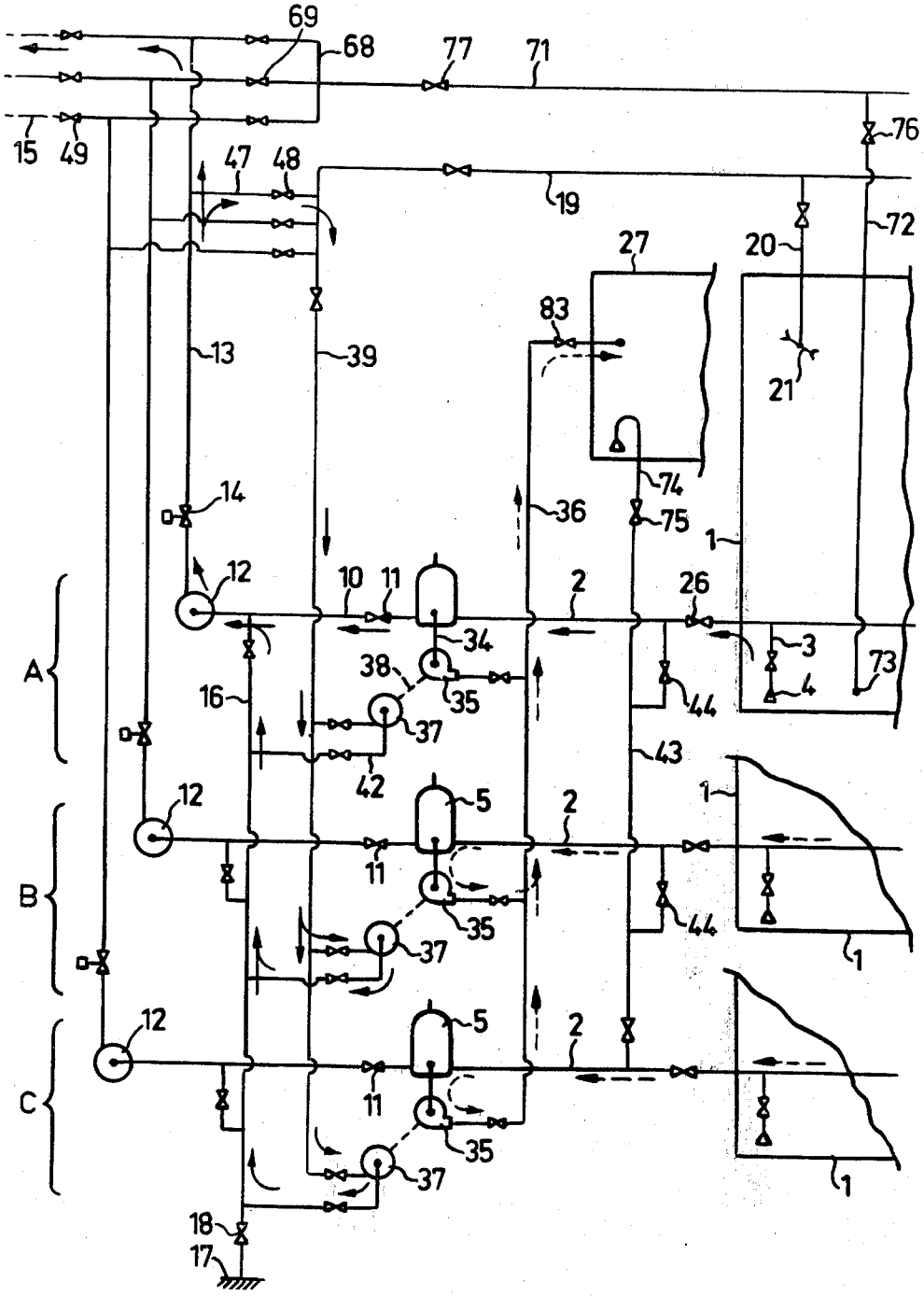
FIGS. 9 and 10 illustrate further utilization possibilities for the basic diagram according to FIG. 8.

After-draining in this way is illustrated in FIG. 9, the tube system of which is the same as that of FIG. 8. In FIG. 9 heavy arrows and dashed arrows designate the flow of oil, which is being unloaded or utilized as propulsive liquid, and flow of oil which is being after-drained, respectively.

Unloading of oil can be carried out e.g. by the main pump 12 of system A to tanks ashore (not shown) through the disconnectable pipe 15. Part of the oil is, however, fed as propulsive liquid to the turbines 37 of the systems B and C and is recirculated to the main pump 12 of the system A after having passed through the impellers of the turbines, all in accordance with the flow designations in the drawing.

At the same time the shut off valves 11 of the systems B and C are shut and the main pumps 12 are not in operation. In this case the cargo tanks 1 which are connected to the main suction pipe 2 of the systems B and C may be after-drained by the drainage pump 35 of the respective system. The after-drained oil is fed to the oil separation tank 27 through pipe 36 according to the flow marking in the Figure.

The after-drained oil which is thus supplied to the oil separation tank 27 may then be emptied by the main pump 12 of either system through emptying pipe 74, connection pipe 43 and either main suction pipe 2.

After-draining by means of the main pump often has the consequence that the cargo tanks 1 are not emptied completely, even when it is provided with a gas evacuation system (members 4–9 and 14) (FIG. 1). Through after-draining by means of the drainage pump 35 in accordance with the invention in the manner described above it is made possible to empty the cargo tanks almost completely.

Furthermore, the main suction pipe 2 and the gas separation tank 5 are thus also drained, which is not possible when after-draining is carried out by means of the main pump 12.

If, during after-draining according to the invention, the drainage pump 35 is driven by a liquid turbine, the latter may receive its propulsive liquid either from one or more of the main pumps 12 which are unloading oil, or from one or more main pumps 12 which are pumping water. The latter case is suitable, e.g. when ballast water is pumped into the ship by means of the main pump(s) 12. This mode of procedure is apparent from FIG. 10 which illustrates the filling of ballast water into certain cargo tanks 1 from the sea intake 17 by means of the main pump 12 of system A. Part of the water from the main pump 12 (system A) is fed to the turbines 37 of all sytems in the example shown. Thus, the shut off valve 11 is closed in all systems.

Figure 10:
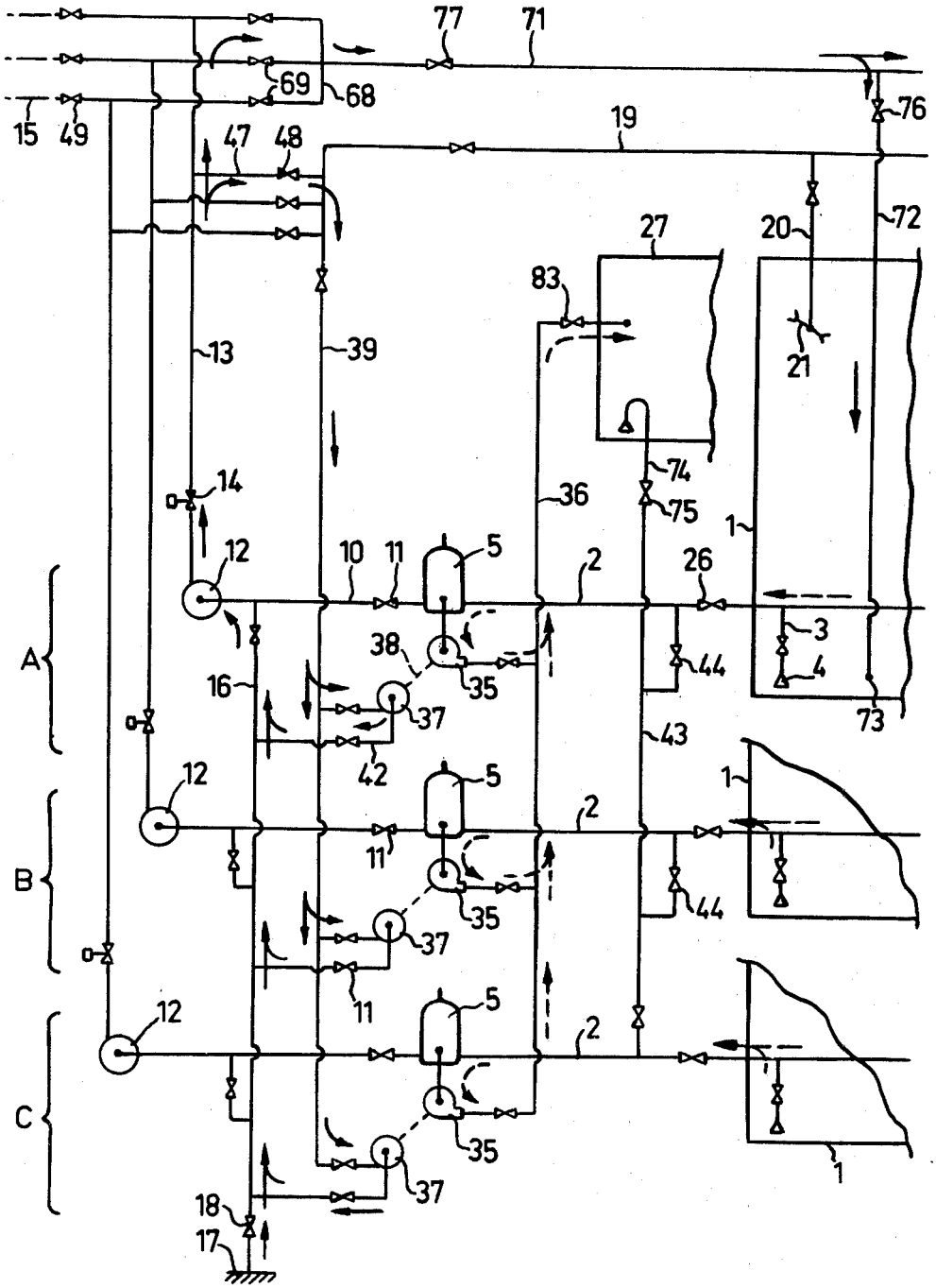

After-draining is now carried out in all systems (A, B and C) in the same way as described above in connection with FIG. 9 from cargo tanks other than those which are filled with ballast. In FIG. 10 solid arrows designate the flow of water to become ballast and water as propulsive liquid, and dashed arrows flow of oil which is being after-drained.

According to this method ballasting can be carried out by means of one or more main pumps 12, at the same time as one or more drainage pumps 35 are utilized for the after-draining of oil. Thanks to the fact that it is possible in this way to ballast water and after-drain oil simultaneously the time is reduced, which the ship has to spend on the quay in connection with the unloading of oil.

Figure 11:
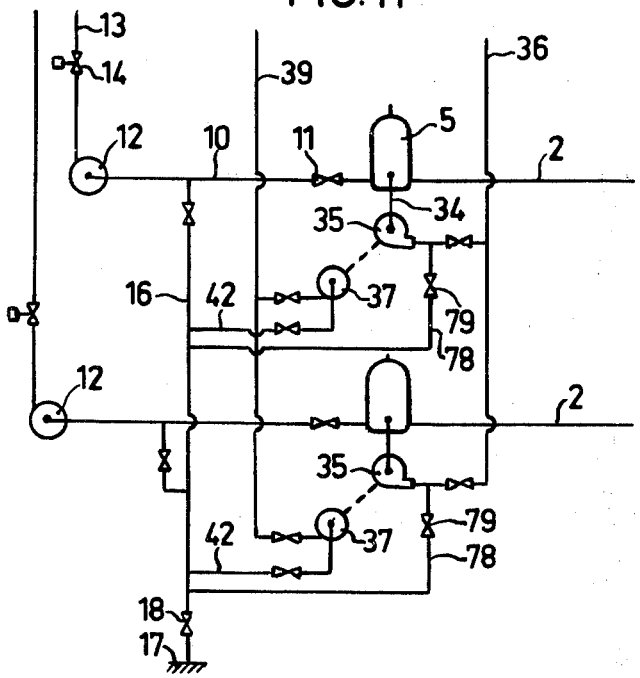
FIGS. 11 and 12 are simplified views of modified arrangements of the diagram according to FIG. 8.

At wash-draining by means of the drainage pump(s) 35 the outlet of the pump(s) may in an advantageous arrangement be connected, in addition to the oil separation tank 27, also to the sea suction pipe 16 by a pipe 78 having a shut off valve 79, as is shown in FIG. 11. Alternatively, the pressure pipe of the drainage pump(s) 36 may be connected to the main suction pipes 2 by means of a pipe 80 having a shut off valve 81 according to FIG. 12.

Figure 12:
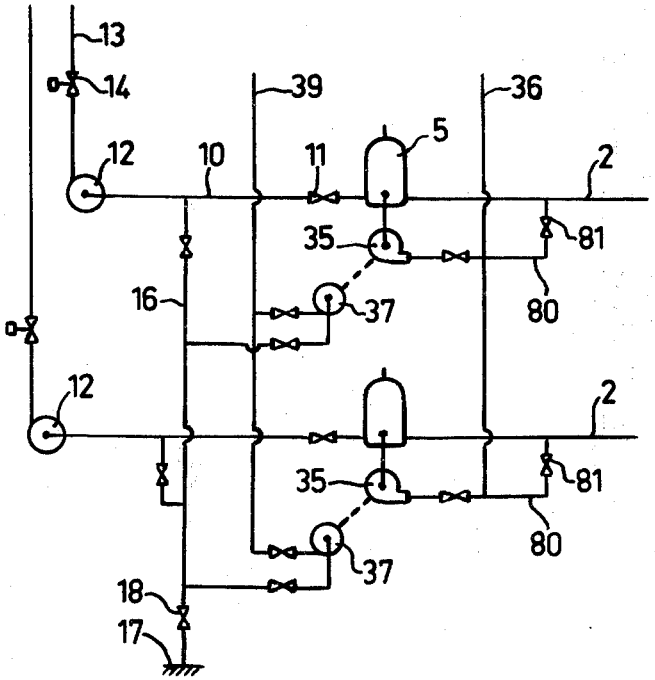

Through the piping system according to FIGS. 11 and 12 one or more drainage pumps can pump direct to the suction system of one or more pumps 12, so that oil from wash-draining of one (or more) pipe systems and their cargo tanks is sequentially unloaded by the main pump(s) 12 of one or more other tube systems.

Figure 13:
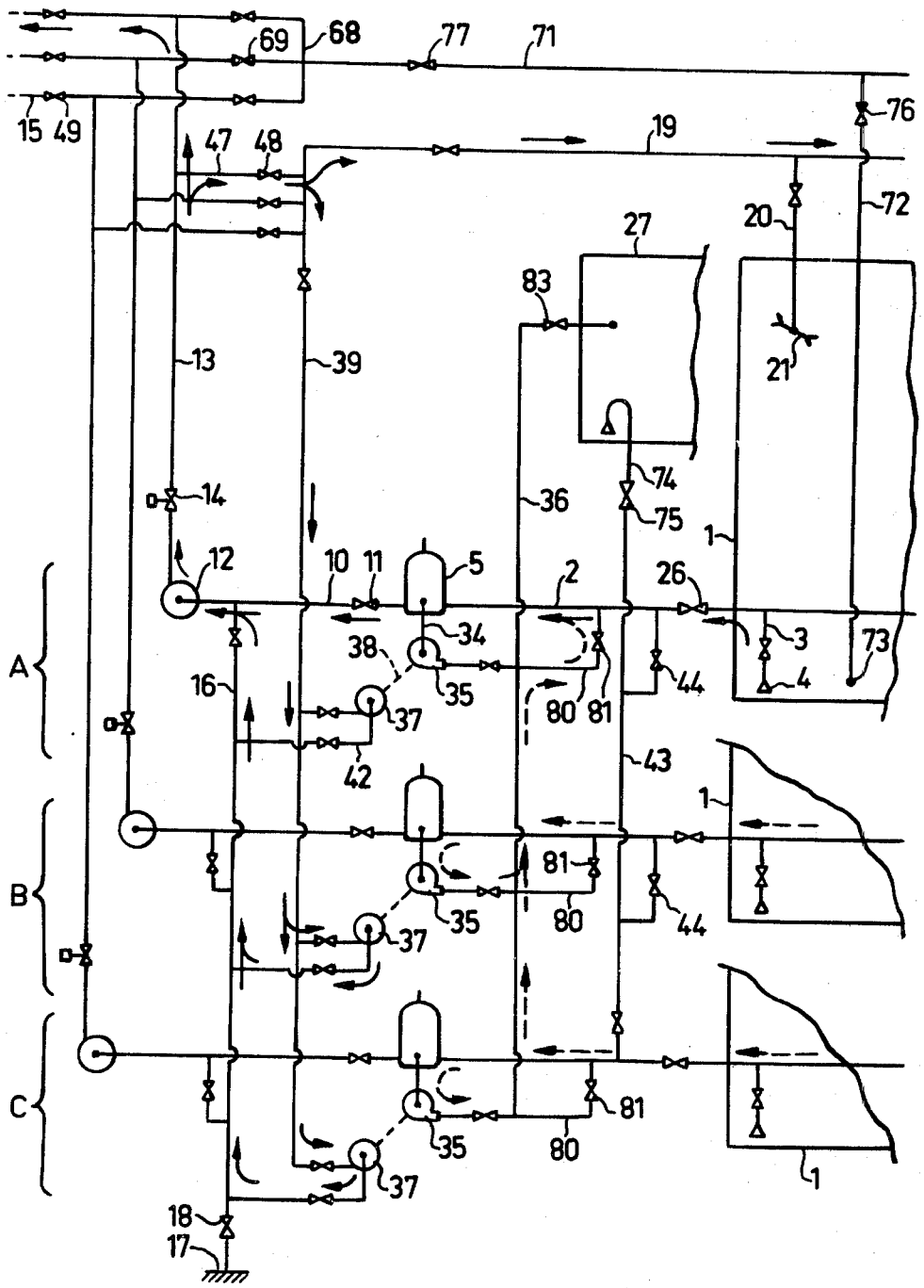
FIG. 13 illustrates a mode of utilization of the basic diagram according to FIG. 12.

Wash-draining by means of the drainage pump 35 is particularly advantageous in those instances, when clean-flushing of some previously emptied tanks is carried out with oil and at the same time as other cargo tanks 1 which are filled with crude oil, wholly or in part are unloaded. This is illustrated in FIG. 13 and is carried out in such a way that during the unloading of oil by means of a main pump 12 part of the oil is by means of this pump applied to the flush or spray apparatus 21 through the tank flush pipe 19. Such flushing or washing is utilized for the purpose of dissolving sediment accumulations in the cargo tanks 1 to permit the unloading even of such accumulations. Thanks to the invention it is thus not necessary to carry out the draining of sediments dissolved in this way directly by any main pump 12, which would get heavily worn by the sediment.

The drainage pump 35 can in this instance suck up oil and sediment and pump it over to the suction pipe 2 of another tube system, the main pump 12 of which is simultaneously unloading pure oil. This main pump 12 may then unload (pump ashore) the sediments dissolved in great quantities of oil, whereby the wear of the main pump will be small.

This may be accomplished in accordance with the flow designations in FIG. 13, in which solid arrows indicate the flow of oil which is utilized as driving or propulsive liquid and oil which is being unloaded, and dashed arrows indicate the flow of oil and sediments which is being wash-drained. The piping arrangement of this Figure is in consert with the arrangement shown in FIG. 12.

In FIG. 13 there is shown how oil is unloaded from a cargo tank 1 by means of the main pump 12 of system A to tanks ashore (not shown) through the pipe 15. A certain quantity of such oil is, however, conducted away, firstly through pipe 19 to the flush or spray apparatus 21 of other cargo tanks 1, which are connected to the systems B and C, and secondly through pipe 39 as propulsive liquid to the turbines 37 of the systems B and C.

Wash draining from cargo tanks 1 comprised in the systems B and C is carried out by the drainage pumps 35 of these systems. These drainage pumps press wash-drained oil and sediments to the main suction pipe 2 of system A through pipes 36 and 80 (system A). In the main suction pipe 2 the flush-drained oil will mix with a considerably greater flow of oil which is being unloaded by the main pump 12 of system A.

Although only some preferred embodiments and applications of the invention have been described and shown in the drawings, it is obvious to those versed in the art that the invention can be modified in different ways within the scope of the following claims.

What I claim is:

1. Apparatus for unloading and draining liquid from a tank and for cleaning the tank, said apparatus comprising at least one main pump, main pump for substantially emptying said tank, a gas separation tank interposed in said main suction pipe, a main pressure pipe leading from said main pump, a wash liquid source, means connecting the inlet of said main pump to said wash liquid source, a pressure fluid source, spray means provided in said cargo tank for the cleaning thereof and connected to said pressure fluid source, a drainage pump provided for draining, wash-draining and after-draining and including a rotatable pump wheel, a liquid turbine for driving said drainage pump, means connecting the inlet of said drainage pump to said main suction pipe, and a gas sucking means connected to said main suction pipe for sucking gas from the pump wheel of said drainage pump.

2. Apparatus according to claim 1, further comprising means for driving the liquid turbine by liquid from the main pressure pipe of said main pump.

3. Apparatus according to claim 2, wherein the driving or propulsive liquid is cargo liquid.

4. Apparatus according to claim 2, wherein the driving or propulsive liquid is wash liquid.

5. Apparatus according to claim 1, further comprising a cargo liquid separation tank, pipe means for connecting the outlet of the drainage pump to said cargo liquid separation tank, and shut off valve means interposed in said pipe means.

6. Apparatus according to claim 1, further comprising a second pipe means for connecting the outlet of the drainage pump to the suction pipe of said main pump, and a second shut off valve means interposed in said second pipe means.

7. Apparatus according to claim 5, further comprising means for selective connection of the outlet of said drainage pump to said cargo liquid separation tank and said main suction pipe of said main pump.

8. Apparatus according to claim 1, in which said drainage pump is connected to the lower portion of said main suction pipe.

9. Apparatus according to claim 1, in which said drainage pump is connected to the lower portion of said gas separation tank, below the connection of the suction pipe to the gas separation tank.

10. Apparatus according to claim 1, wherein said pump wheel has a substantially vertical rotational axis and the inlet of said drainage pump faces upwards.

11. Apparatus according to claim 1, wherein said pump wheel and said liquid turbine are built together in one unit.

12. Apparatus according to claim 1, further comprising a third shut off valve means which is interposed in said suction pipe of the main pump between the inlet of the main pump and said gas separation tank.

13. Apparatus according to claim 4, further comprising a valved pipe means for interconnecting the outlet of said liquid turbine and said suction pipe.

14. Apparatus according to claim 13, comprising another pipe means interconnecting the outlet of the drainage pump and said suction pipe, and another shut off valve interposed in said other pipe means.

15. Apparatus according to claim 1, further comprising a pipe means for connecting the lower portion of said cargo liquid separation tank to said main suction pipe, and a shut off valve interposed in said pipe means.

16. In a method of cleaning and emptying a liquid cargo tank on board a ship, the steps of:

A. sucking wash liquid from a wash liquid source by a primary pump;

B. supplying part of said wash liquid to spray means located in said tank;

C. simultaneously supplying another part of said wash liquid to a hydraulic driving means for a secondary rotary pump;

D. sucking from said cargo tank by means of said secondary rotary pump wash liquid expelled by said spray means into said cargo tank;

E. pumping wash liquid to a place of disposal by means of said secondary pump while simultaneously;

F. sucking off gas from the wash liquid entering said secondary pump.

17. In a method of cleaning and emptying a plurality of liquid cargo tanks on board a ship, the steps of:

A. sucking wash liquid from a wash liquid source by a first primary pump;

B. supplying part of said wash liquid to at least one of an equal plurality of spray means located in said tanks;

C. simultaneously supplying another part of said wash liquid to at least one of an equal plurality of hydraulic driving means each associated with an individual one of said cargo tanks annd each driving an individual secondary pump;

D. sucking from said cargo tanks by means of at least one secondary pump wash liquid expelled by said spray means into said cargo tanks;

E. pumping wash liquid to a liquid separator tank by means of at least one of said secondary pumps; and F. pumping off wash liquid from said liquid separator tank by means of a second primary pump.

18. In a method for emptying a plurality of shipboard liquid cargo tanks of the type wherein a wash liquid is pumped into one of said cargo tanks by a first primary pump, wherein the improvement comprises:

A. conducting part of the wash liquid pumped by said first primary pump to a hydraulic drive means for a secondary pump associated with a second cargo tank;

B. after-draining cargo after-drained from the second cargo tank by said secondary pump;

C. pumping said after-drrained cargo liquid to a collecting tank; and

D. pumping cargo liquid from said collecting tank by means of a second primary pump.

19. Method according to claim 18, in which said wash liquid pumped by said first primary pump is sea water, and wherein said first primary pump pumps a greater amount of sea water than is pumped to said one cargo tank and to said hydraulic drive means, and wherein the balance of said sea water is pumped as ballast into one of said cargo tanks.

20. Method according to claim 18, in which said fluid pumped by said first primary pump is cargo oil, and wherein said first primary pump pumps a greater amount of cargo oil than is pumped to said one cargo tank and to said hydraulic drive means, and wherein the balance of said pumped cargo oil is pumped into a delivery pipe.

21. A method of emptying a plurality of liquid cargo tanks on board a ship, the steps of A. emptying one of said cargo tanks by means of a first primary pump;

B. leading part of said liquid cargo as wash liquid to spray means located in other cargo tanks for the cleaning thereof;

C. simultaneously supplying another part of said liquid cargo to at least one hydraulic drive means for a secondary pump associated with at least one of said other cargo tanks;

D. by means of said secondary pump, after-draining liquid from the cargo tank associated with said secondary pump;

E. pumping by said secondary pump said after-drained cargo liquid to a collecting means; and F. pumping off cargo liquid from said collecting means by means of said first primary pump.

22. Shipboard apparatus for after-draining, cleaning and wash-draining a plurality of cargo tanks, said apparatus comprising:

A. an equal plurality of primary pumps;

B. an equal plurality of suction pipes each interconnecting an individual cargo tank with an associated primary pump;

C. an equal plurality of pressure pipes, each leading from its individual primary pump;

D. spray means in each of said cargo tanks for the cleaning thereof;

E. first pipe means interconnecting said spray means with at least some of said pressure pipes for leading liquid therefrom to said spray means;

F. an equal plurality of units, each comprising:

a. a secondary rotary pump for evacuating liquid from an individual, associated one of said cargo tanks, and b. a hydraulic drive means for each of said secondary pumps;

G. second pipe means interconnecting said pressure pipes with said hydraulic drive means of at least some of said secondary pumps for supplying propulsive liquid thereto;

H. third pipe means for leading fluid from at least some of said suction pipes to the respective inlets of at least some of said secondary pumps; and I. means for leading fluid from the respective outlets of at least some of said secondary pumps to the inlet of at least one of said primary pumps for evacuating such fluid by means thereof.

23. Apparatus according to claim 22, further comprising a sea water intake, fourth pipe means interconnecting the sea water intake with the respective suction pipes of at least some of said primary pumps and a shut off valve in said forth pipe means.

24. Apparatus according to claim 23, further comprising an equal plurality of shut off valves inserted in said suction pipes between the respective cargo tanks and the connection of said fourth pipe means to the respective suction pipe.

25. Apparatus according to claim 23, further comprising fifth pipe means interconnecting the respective outlets of at least some of said secondary pumps with said fourth pipe means, and second shut off valve means interposed in said fifth pipe means.

26. A system according to claim 22, further comprising a liquid cargo separation tank, a sixth pipe means interconnecting the respective outlets of at least some of said secondary pumps with said separation tank, and a seventh pipe means interconnecting said separation tank with at least some of said suction pipes of said primary pumps.

27. Apparatus according to claim 22, further comprising seventh pipe means for leading fluid from the pressure pipe of at least some of said primary pumps into at least one of said cargo tanks, and a third shut off valve means interposed in said seventh pipe means.

28. Apparatus according to claim 22, further comprising eighth pipe means interconnecting the respective outlets of at least some of said secondary pumps with said pressure pipe of at least some of said primary pumps, and a fourth shut off valve means interposed in said eighth pipe means.

29. Apparatus according to claim 4, further comprising pipe means connecting the outlet of said liquid turbine to said wash liquid source, and a valve interposed in said pipe means.

* * * * *

PO-1050
(5/69)

UNITED STATES PATENT OFFICE
CERTIFICATE OF CORRECTION

Patent No. 3,989,070 Dated November 2, 1976

Inventor(s) Lars-Olof Liberg

It is certified that error appears in the above-identified patent and that said Letters Patent are hereby corrected as shown below:

Abstract, Line 19: "themain" should read --the main--.
Column 1, Line 30: "trough" should read --through--.
Column 3, Line 38: "Summary of the Invention" should read --SUMMARY OF THE INVENTION--.
Column 3, Line 45: "striking" should read --stripping--.
Column 4, Line 51: "flushor" should read --flush-or--.
Column 5, Line 3: "shut" should read --closed--.
Column 5, Lines 33 & 34: "dimenisoned" should read --dimensioned--.
Column 5, Line 67: "thru" should read --through a--.
Column 6, Line 26: "48" should read --58--.
Column 7, Line 66: "of" should read --or--.
Column 10, Line 54: After "main pump," insert --a main suction pipe for connecting said tank to said--
Column 12, Line 9: "annd" should read --and--.
Column 12, Line 26" "after-draining cargo after-drained" should read --after-draining cargo liquid--.
Column 12, Line 28: "after-drrained" should read --after-drained--.

Signed and Sealed this

Twelfth Day of April 1977

[SEAL]

*Attest:*

RUTH C. MASON
*Attesting Officer*

C. MARSHALL DANN
*Commissioner of Patents and Trademarks*